US006407505B1

(12) United States Patent
Bertsche

(10) Patent No.: US 6,407,505 B1
(45) Date of Patent: Jun. 18, 2002

(54) VARIABLE ENERGY LINEAR ACCELERATOR

(75) Inventor: Kirk Joseph Bertsche, San Jose, CA (US)

(73) Assignee: Siemens Medical Solutions USA, Inc., Iselin, NJ (US)

( * ) Notice: Subject to any disclaimer, the term of this patent is extended or adjusted under 35 U.S.C. 154(b) by 0 days.

(21) Appl. No.: 09/775,526

(22) Filed: Feb. 1, 2001

(51) Int. Cl.[7] ..... H05H 9/04

(52) U.S. Cl. ..... 315/5.41; 315/5.42; 315/5.46; 315/505

(58) Field of Search ..... 315/5.41, 5.42, 315/5.46, 505

(56) References Cited

U.S. PATENT DOCUMENTS 4,027,193 A * 5/1977 Schriber ..... 315/5.41
4,118,653 A * 10/1978 Vaguine ..... 315/5.41
4,162,423 A 7/1979 Tram ..... 315/5.41
4,286,192 A 8/1981 Tanabe et al. ..... 315/5.41
4,382,208 A 5/1983 Meddaugh et al. ..... 315/5.42
4,400,650 A 8/1983 Giebeler, Jr. ..... 315/5.41
4,629,938 A 12/1986 Whitman ..... 315/5.41
4,651,057 A 3/1987 Uetomi et al. ..... 315/5.41
4,746,839 A 5/1988 Kazusa et al. ..... 315/5.41
5,734,168 A 3/1998 Yao ..... 250/492.3
5,821,694 A 10/1998 Young ..... 315/5.41

* cited by examiner

*Primary Examiner*—Bruce Anderson
*Assistant Examiner*—Nikita Wells

(57) ABSTRACT

A device for use in a linear accelerator operable to accelerate charged particles along a beam axis. The device includes a first end section, a second end section, and a transition section interposed between the first and second end sections. The sections are coupled together to form a plurality of accelerating cavities aligned along the beam axis. The first and second sections are configured to operate in a fixed collective resonant mode and the transition section is tunable such that resonant modes of the transition section may be tuned to lie at generally the same frequency as the resonant mode of the first and second sections.

40 Claims, 6 Drawing Sheets

VARIABLE ENERGY LINEAR ACCELERATOR

FIELD OF THE INVENTION

The present invention relates generally to a charged particle acceleration device, and more particularly to a variable energy standing wave linear accelerator.

BACKGROUND OF THE INVENTION

Many different types of devices may be used to accelerate charged particles. All rely on either electric fields or rapidly changing magnetic fields to impart energy to charged particles. Circular accelerators are generally driven by RF (Radio Frequency) signals (e.g., cyclotrons, synchrotrons, microtrons) but may also be driven by pulsed magnetic fields (e.g., betatrons). Linear accelerators (linacs) may be DC, electrostatic devices (e.g., VandeGraaf or tandem accelerators, including pelletrons and dynamitrons), pulsed magnetic field devices (e.g., induction linacs), or RF devices (e.g., drift tube linacs, standing wave linacs, traveling wave linacs, RF quadrupole accelerators).

For the parameters desired in conventional radiation therapy (e.g., acceleration of electrons to multi-MeV energies at average current of below about 500 $\mu$A in compact structure), standing wave or traveling wave accelerators are a preferred choice. Currently, most electron accelerators available for medical radiation therapy applications are standing wave linear accelerator structures, with occasional use of traveling wave structures, betatrons, or microtrons for specific applications.

A radiation therapy device generally includes a gantry which can be swiveled around a horizontal axis of rotation in the course of a therapeutic treatment. An electron linear accelerator is located within the gantry for generating a high energy radiation beam for therapy. This high energy radiation beam may be an electron beam or photon (x-ray) beam, for example. During treatment, the radiation beam is trained on a zone of a patient lying in the isocenter of the gantry rotation.

Linear accelerators may be used in the medical environment for a variety of applications. A beam of charged particles (e.g., electrons) from a linear accelerator may be directed at a target which is made of a material having a high atomic number, so that an x-ray beam is produced for radiation therapy. Alternatively, the beam of charged particles may be applied directly to a patient during a radiosurgical procedure. Such radiosurgery has become a well-established therapy in the treatment of brain tumors. A high-energy beam may be directed at a localized region to cause a breakdown of one or both strands of the DNA molecule inside cancer cells, with the goal of at least retarding further growth and preferably providing curative cancer treatment.

A conventional RF linear accelerator includes a series of accelerating cavities that are aligned along a beam axis. A particle source, which for an electron accelerator is typically an electron gun, directs charged particles into the first accelerating cavity. As the charged particles travel through the succession of accelerating cavities, the particles are accelerated by means of an electromagnetic field. A RF source is coupled to the accelerator to generate the necessary field to operate the linear accelerator. The accelerated particles from a clinical linear accelerator have a high energy (e.g., up to 25 MeV). The output beam is often directed to a magnetic bending system that functions as an energy filter. The beam is typically bent by approximately 270 degrees.

Then either the output beam of high energy particles or an x-ray beam generated by impinging a target with the output beam is employed for radiation treatment of a patient.

As discussed above, the most common accelerator type for radiation therapy is the standing wave accelerator. Standing wave accelerators are often used for other applications as well, such as basic nuclear and subatomic research, positron production, industrial x-raying, food irradiation, product sterilization, plastic and rubber polymerization, and oil and gas logging.

A standing wave linear accelerator is comprised of a series of high-Q resonant cavities, each weakly coupled to its two nearest neighbors. RF energy is coupled into the structure, typically from a rectangular waveguide through a coupling iris into one of the cavities. This sets up a standing wave along the chain of cavities, causing the cavities to resonate at high voltages. If the cavities are designed with holes along their axes, and with the appropriate dimensions, many electrons can be accelerated along the axis of the cavities.

A series of N such identical cavities will resonate at N different collective resonant modes and frequencies. The RF voltage in any cavity i (where i cavities are numbered from ) through N−1) is proportional to $\cos(m\pi i/(N-1))\cos(\omega t)$, where mode number m may take the values) through (N−1). Sometimes m is referred to as the mode of the structure, but more often the mode of the structure is referred to as $m\pi/(N-1)$.

For example, assume the structure is resonating in the zero mode (m=0). Then each cavity will have an identical excitation and all will resonate in phase. If the structure is resonating in $\pi$ mode (m=N−1), each cavity will have an identical RF voltage amplitude, but the phase will reverse from cavity to cavity (i.e., there will be a phase shift of $\pi$ from each cavity to the next). If there are an odd number of cavities and m=(N−1)/2, the structure will be in $\pi/2$ mode. The first cavity will have a strong field excitation, the second will be unexcited, the third will have a strong field with an inverted phase, the fourth will be unexcited, etc.

The $\pi/2$ mode has significant practical advantages, as it is much more tolerant to mistuning than the other collective resonant modes. However, only roughly half of the cavities have strong fields and are useful for acceleration, the others are unexcited. The unexcited cavities may be designed to be smaller than the accelerating cavities (since they do not have high fields) and may be moved to the side of the structure (so that they do not take up space along the axis which can be used for acceleration). This yields the side coupled cavity $\pi/2$ mode standing wave structure. FIG. 1 illustrates a conventional side coupled standing wave linear accelerator. For additional information on the design and operation of standing wave structures, see "Principles of Charged Particle Acceleration" by Stanley Humphries, Jr., published by John Wiley and Sons, 1999.

It is often desirable to operate a coupled cavity standing wave linear accelerator at different energies. This may be accomplished by changing the excitation of the accelerating cavities. However, this tends to cause particles to slide in phase, thus adversely affecting the beam dynamics and reducing the efficiency of the accelerator. Another option is to operate a nominally $\pi/2$ mode accelerator in a different mode. However, this puts large fields in side cavities and it is difficult to optimize performance for two different modes.

Another option is to make an accelerator with two independent sections, each section having independent phase or amplitude adjustments. This technique is commonly used in large research accelerators, and has also been used for commercial x-band accelerators. However, this configuration is costly and complex, and requires careful frequency matching of the two accelerator sections.

Another conventional approach is to change the coupling at a fixed point along the accelerator. This can be accomplished by various methods. For example, two side cavities may be used to couple two main cavities, with each cavity having different coupling ratios and with one cavity shorted, as disclosed in U.S. Pat. No. 4,746,839. Also, a single side cavity may be mechanically distorted to change the coupling ratio as disclosed in U.S. Pat. Nos. 4,382,208 and 4,400,650. A side cavity may also be mechanically modified to change the resonant mode as disclosed in U.S. Pat. No. 4,286,192. These methods all have drawbacks. For example, the change of coupling from the main cavity to side cavity also changes the second-nearest-neighbor coupling between neighboring main cavities. This shifts the desired tuning frequency of the main cavities, resulting in the main cavities being mistuned. This will produce fields in the nominally unexcited side cavities and possible field tilts in the main cavities. Furthermore, the mechanical adjusting or shorting device must be designed to handle large currents, especially since there are now non-zero fields in the side cavities.

U.S. Pat. Nos. 4,629,938 and 4,651,057 disclose additional methods for greatly reducing the coupling at a location within the accelerator, thus reducing the accelerating fields downstream. These methods are also subject to the drawbacks discussed above. Moreover, the reduced coupling results in a less stable structure. The fields in the downstream section may be driven by the beam, causing the accelerator performance to be highly current-dependent. To avoid this, a second switched side cavity may be added to make the downstream section non-resonant as disclosed in U.S. Pat. No. 5,821,694. Another drawback to the these conventional designs is that they do not always allow for equally effective multi-energy operation.

SUMMARY OF THE INVENTION

A variable energy linear accelerator is disclosed. In one embodiment the device of the present invention is for use in a linear accelerator operable to accelerate charged particles along a beam axis. The device generally comprises a first end section, a second end section, and a transition section interposed between the first and second end sections. The sections are connected together to form a plurality of accelerating cavities aligned along the beam axis. The first and second end sections are configured to operate in a fixed collective resonant mode and the transition section is tunable such that two different collective resonant modes of the transition section may be tuned to lie at generally the same frequency as the resonant mode of the first and second sections.

In another aspect of the invention, a system for delivering charged particles generally comprises a particle accelerator having an input for connection to a source of charged particles and a signal source for energy transfer engagement with the charged particles within the particle accelerator. The particle accelerator includes a beam path extending to an exit window and comprises a first end section, a second end section, and a transition section interposed between the first and second end sections. The sections are connected together to form a plurality of accelerating cavities aligned along said beam axis. The first and second sections are configured to operate in a fixed collective resonant mode and the transition section is tunable such that two different collective resonant modes of the transition section may be tuned to lie at generally the same frequency as the resonant mode of the first and second sections.

The above is a brief description of some deficiencies in the prior art and advantages of the present invention. Other features, advantages, and embodiments of the invention will be apparent to those skilled in the art from the following description, drawings, and claims.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

The following description is presented to enable one of ordinary skill in the art to make and use the invention. Descriptions of specific embodiments and applications are provided only as examples and various modifications will be readily apparent to those skilled in the art. The general principles described herein may be applied to other embodiments and applications without departing from the scope of the invention. Thus, the present invention is not to be limited to the embodiments shown, but is to be accorded the widest scope consistent with the principles and features described herein. For purpose of clarity, details relating to technical material that is known in the technical fields related to the invention have not been described in detail.

Figure 1:
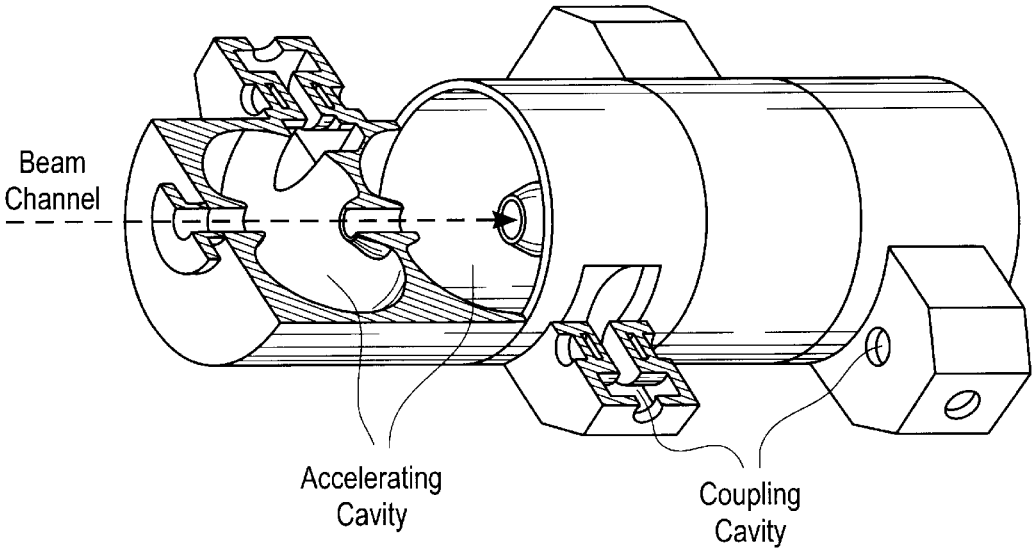
FIG. 1 is a cross-sectional view of a conventional side coupled standing wave linear accelerator.
Figure 2:
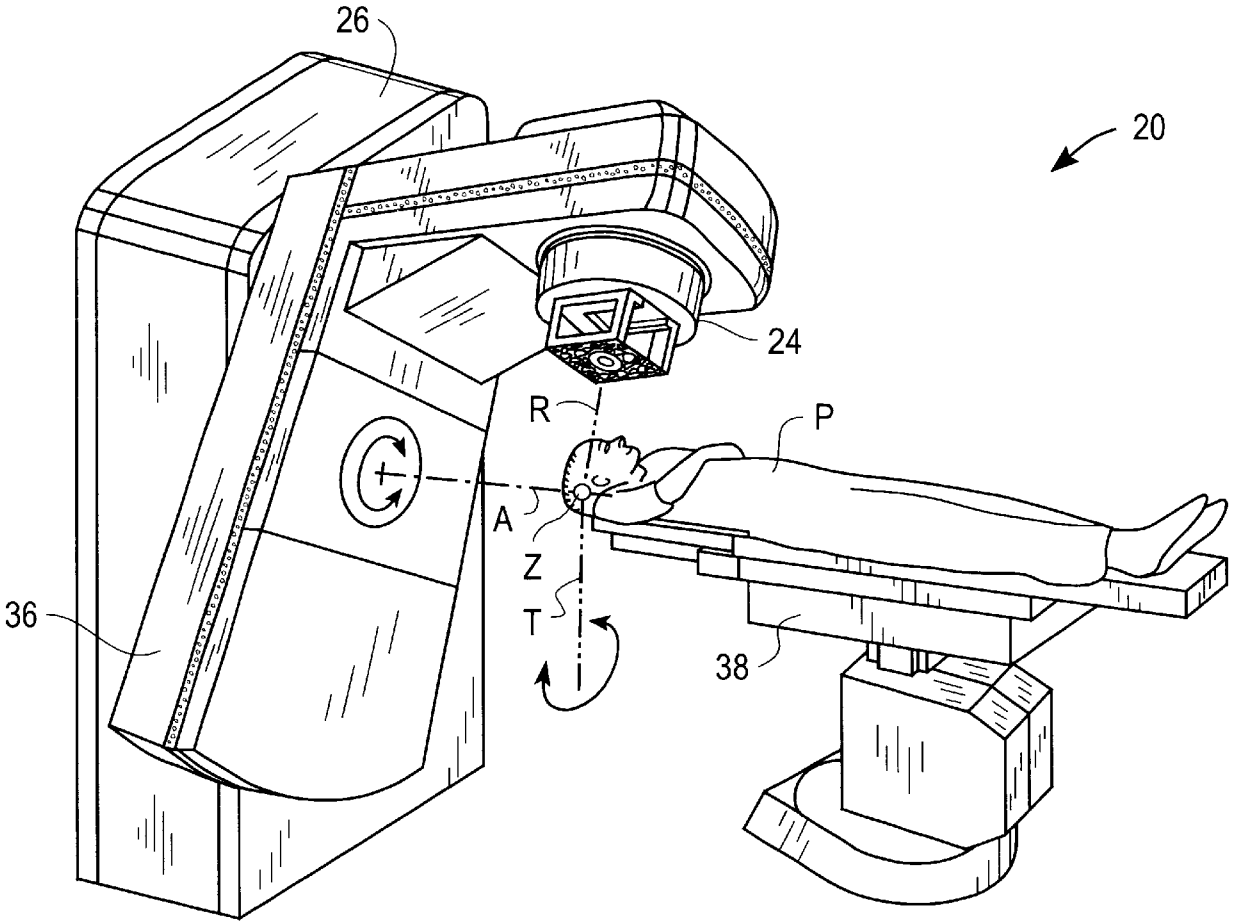
FIG. 2 is a diagram of a radiation treatment device having a linear accelerator according to an embodiment of the present invention and a patient positioned for treatment within the treatment device.

Referring now to the drawings, and first to FIG. 2, a radiation treatment device of the present invention is shown and generally indicated at 20. The radiation treatment device 20 includes a beam shielding device within a treatment head 24, a control unit within a housing 26 connected to a treatment processing unit (not shown). The radiation treatment device further includes a gantry 36 which can be swiveled for rotation about axis A in the course of a therapeutic treatment. The treatment head 24 is fixed to the gantry 36 for movement therewith and a linear accelerator is located within the gantry for generating high powered radiation used for therapy. The radiation emitted from the linear accelerator extends generally along axis R. Electron, photon, or any other detectable radiation may be used for the therapy. During treatment, the radiation beam is focused on a zone Z of an object P (e.g., a patient who is to be treated). The zone to be treated is located at an isocenter defined by the intersection of the rotational axis A of the gantry 36, rotational axis T of treatment table 38, and the radiation beam axis R. The treatment device 20 described above is provided as an example of a device for use in delivering a treatment with a linear accelerator having a structure as described below. It is to be understood that the radiation treatment device may be different than the one shown in FIG. 2 without departing from the scope of the invention. Furthermore, the device of the present invention may be used for purposes other than medical treatment. For example, standing wave accelerators are often used for other applications as well, such as basic nuclear and subatomic research, positron production, industrial x-raying, food irradiation, product sterilization, plastic and rubber polymerization, and oil and gas logging. Thus, the present invention is applicable to standing wave linear accelerators in general, and to other accelerators (e.g., microtrons) which may use a series of coupled cavities excited with a standing wave.

Figure 3:
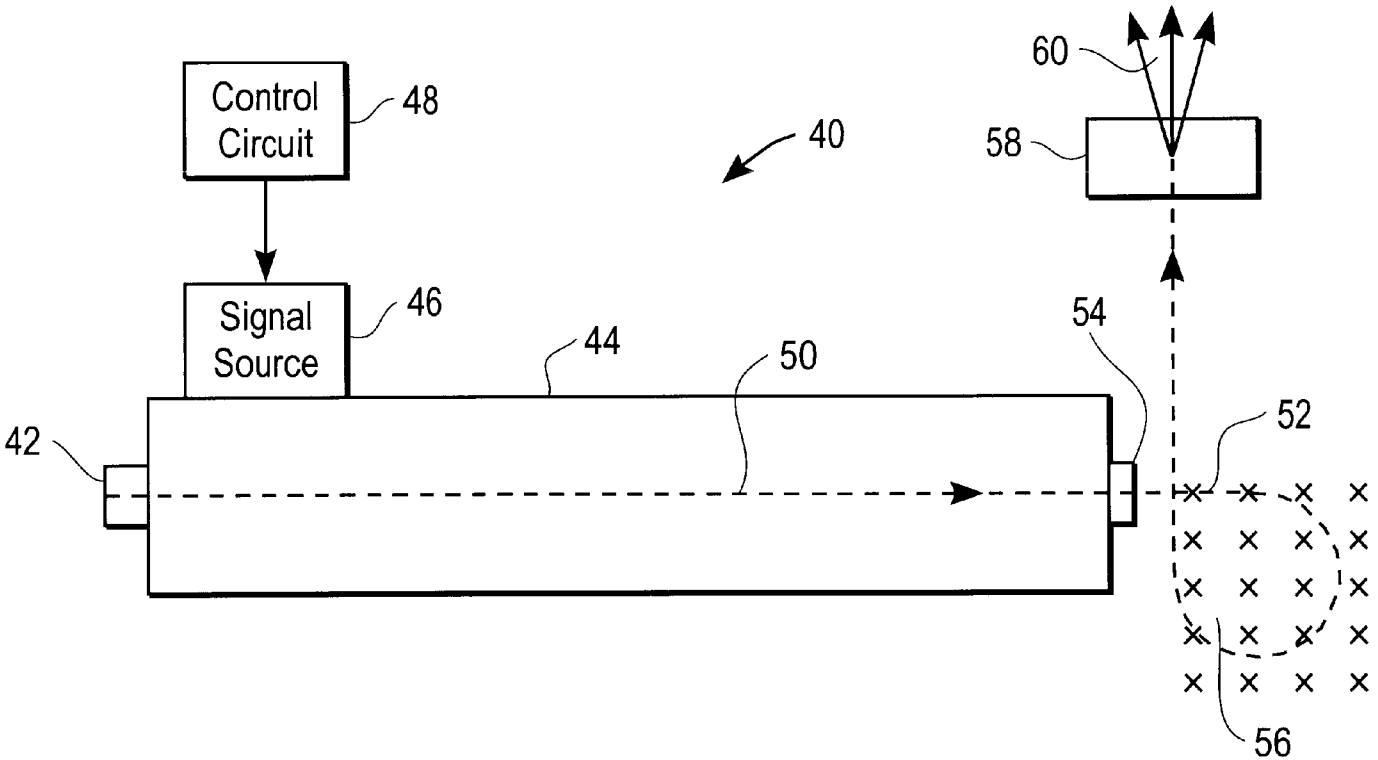
FIG. 3 is a schematic of a linear accelerator of the radiation treatment device of FIG. 2.

FIG. 3 illustrates additional detail of the linear accelerator of the treatment device of FIG. 2. The linear accelerator includes a particle source 42 for directing charged particles into an accelerator device 44. In a preferred embodiment, the particle source is an electron gun which injects electrons into the input end of the accelerator device 44. A driving source is introduced into the accelerator device by a signal source 46. The signal source 46 introduces an electromagnetic wave having a suitable frequency. Radio frequency or high frequency sources are conventionally employed, but the selection of the frequency of the drive signal is not critical to the invention. Optionally, the frequency may be dynamically controlled by a control circuit 48 that is connected within a closed loop system (not shown).

Electrons introduced into the accelerator device 44 by the electron gun are accelerated along the beam axis 50 of the device. The electrons obtain a high energy by virtue of the energy-transfer relationship with the electromagnetic waves established by connection with the signal source 46. A pulsed or steady state output beam of the electrons is emitted from an exit window 54, which is located at the delivery end of the device 44. The exit window 54 may include a thin metal foil. The output beam 52 of charged particles is directed to an achromatic magnetic bending system 56, which acts as an energy filter. The output beam is bent by approximately 270 degrees and is then directed onto a target 58 such as a gold or tungsten target. Impingement of the target 58 by the output beam 52 generates an X-ray beam which is employed for radiation treatment of a patient. Alternatively, the output beam 52 may be applied directly to a patient such as during a radiosurgical procedure to treat a brain tumor. The operations of the magnetic bending system 56 and the target 58 are well known by those skilled in the art.

Figure 4:
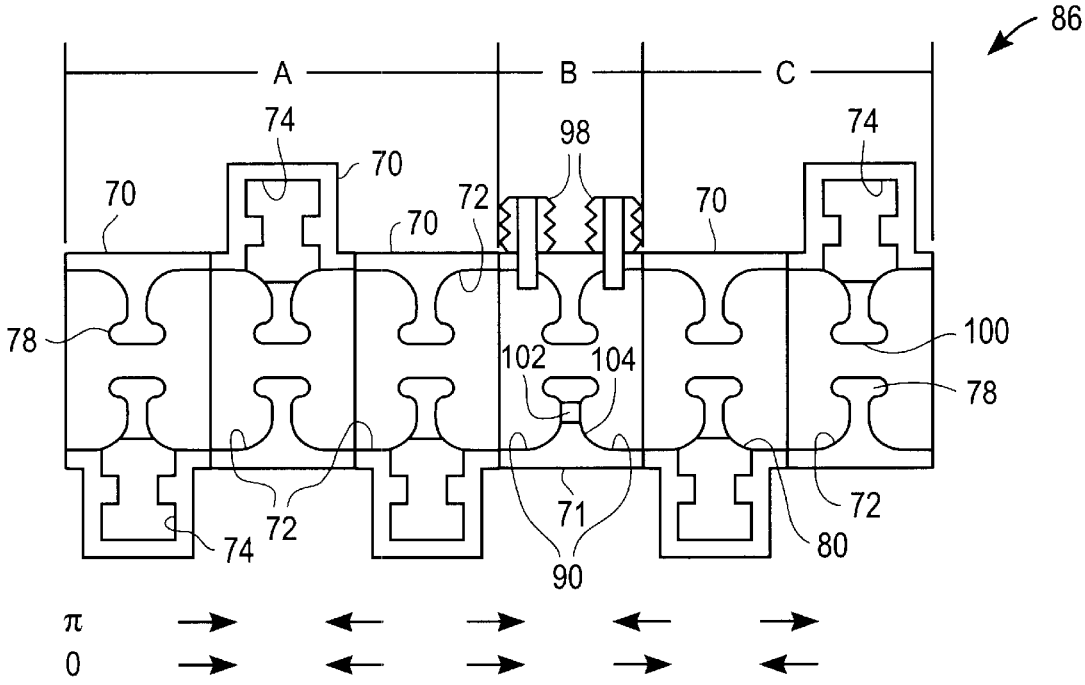
FIG. 4 is a side sectional view of a series of members connected to form a first embodiment of a linear accelerator of the present invention.

Referring now to FIG. 4, a side sectional view of a series of members 70, 71 is shown. The members 70, 71 are connected together to form the linear accelerator. As shown in FIG. 4, two connected members 70 or 70 and 71 define a main accelerating cavity 72 and a side coupling cavity 74. The accelerating cavities 72 are aligned to permit passage of beam 50 through beam axis opening 100 (FIGS. 3 and 4). The accelerating cavities 72 include projecting noses 78 which are used to improve efficiency of interaction of microwave power and electron beam. The side cavities 74 are used to electromagnetically couple the accelerating cavities 72. The intersection region of the side cavity 74 with the accelerating cavity 72 is referred to as an iris (or coupling aperture) 80. The members 70 may be formed as monolithic members (i.e., one half of an accelerating cavity 72 and side cavity 74 formed together as one structure) or the side cavities may be formed independently from the accelerating cavities and attached thereto to form the member 70, 71. It is to be understood that the accelerating cavities 72 may also be used to decelerate particles under certain conditions, as described below.

After members 70, 71 are assembled together, the coupling cavity 74 is off-axis of the electron beam and is connected to the accelerating cavity 72 of the member by the opening (iris) 80. The coupling cavity 74 is connected to each of two accelerating cavities 72. Consequently, when a drive signal having the appropriate frequency is fed to any appropriate cavity in the structure, the electromagnetic waves are in an energy transfer relationship with an electron beam that is directed through the accelerating cavities 72. The beam 50 of charged particles passes through each of the accelerating cavities 72 and is focused and accelerated (or decelerated). The exit energy of the output beam 52 is determined by a number of factors, including the number of accelerating cavities 72 within the accelerator device 40.

As shown in FIG. 4, the linear accelerator contains three sections A, B, C of coupled cavities. For purposes of this description, division conceptually occurs in centers of main accelerator cavities 72. However, the division may occur either in the centers or between the main cavities. Sections A and C are referred to herein as end sections and section B is referred to as a transition section. However, it is to be understood that additional members may be added to either of the end sections A or C, without departing from the scope of the invention. The first and second end sections A, C are operated in the standing wave mode that is known as the $\pi/2$ mode. The frequency of excitation is such that the series of connected structures is excited in a standing wave resonance with $\pi/2$ radians phase shift between each accelerating cavity 72 and the adjacent side cavity 74. The sections operated in $\pi/2$ mode have side cavities 74 that are nominally unexcited and main accelerating cavities 72 with strong fields. When properly tuned (so that the side cavities are unexcited), the ratio of field strengths in adjoining main cavities 72 are determined by the coupling coefficients between the main cavities and the common side cavity 74 that connects them. The coupling cavities 74 are preferably resonant at nearly the same frequency as the accelerating cavities 72. The resonant frequencies are preferably slightly offset from the main cavity frequencies due to high order coupling effects, as is known by those skilled in the art.

The transition section B is tunable such that different collective resonant modes of the section may be tuned to lie at the same frequency as the $\pi/2$ mode of the end sections A, C. The transition section B is a short string of coupled cavities with half-cavities at ends of the string. This string of coupled cavities contains at least two half cavities and therefore has at least two collective resonant modes. At least one of these modes allows the end half cavities to resonate in phase and at least one other allows them to resonant out of phase.

The transition section B is switched between two collective modes of oscillation by shifting the frequency of either mode to the $\pi/2$ resonant frequency of the rest of the structure (i.e., sections A and C). This is accomplished by changing the frequency of cavities 72 or by changing the coupling, or both. In one mode, the end half-cavities of the transition section will resonant in phase and in the second mode, they will resonant 180 degrees out of phase. The resonant mode of each cavity is unchanged, however, the collective resonant mode of the coupled chain of cavities in transition section B is changed. When the transition section B is switched between modes, the phase of the downstream accelerating section C is reversed. One phase continues to accelerate the charged particles while the other phase decelerates the particles. This results in an accelerator operating very efficiently at a lower output energy.

FIG. 4 illustrates a first embodiment of the present invention, generally indicated at 86. The transition section B is formed from two half-cavities 90 coupled together by openings 102 in cavity walls 104. The transition section B may be operated in either 0 or π mode. These modes of the transition section B may be tuned to the π/2 frequency of the rest of the structure (i.e., end sections A, C) by changing the frequencies of the two half cavities 90. The frequencies of the transition section cavities may be changed, for example, with tuning plungers (tuning devices) 98, as is well known by those skilled in the art. Since the tuning plungers 98 are located in a high current region it may be necessary to incorporate choke joints for good reliability. Alternatively, the cavities may be deformable, similar to those used in klystrons. The tuning plungers 98 will actually tune the full accelerating cavity 72 made up of a portion of the transition section and a portion of the end section (either A or C). Thus, they need not be located in the transition section half of the cavity as shown. They may also be located in the end section half of the cavity, or preferably in the center of the cavity. When the transition section B operates in 0 'mode, the beam decelerates after the transition section and exits the accelerator at a lower energy. This is depicted by the arrows located below the linear accelerator of FIG. 2 for the π mode and the 0 mode of the transition section B. The arrows indicate the instantaneous directions of the electric fields in each cavity.

Since the cavities in the transition section B are not operating in a π/2 mode, there will be a power flow phase shift that is generally proportional to power flow and inversely proportional to coupling strength. The power flow phase shift may be reduced by increasing the coupling strength or may be compensated for by slightly changing the length of transition section B. The power flow phase shift is not identical for both operating modes of the transition section B. There is less power flow for the 0 mode since the beam loses power to the downstream section C. Thus, there will be less phase shift for the 0 mode than for the π mode. The length of the transition section B may be adjusted to compensate for this effect.

Figure 5:
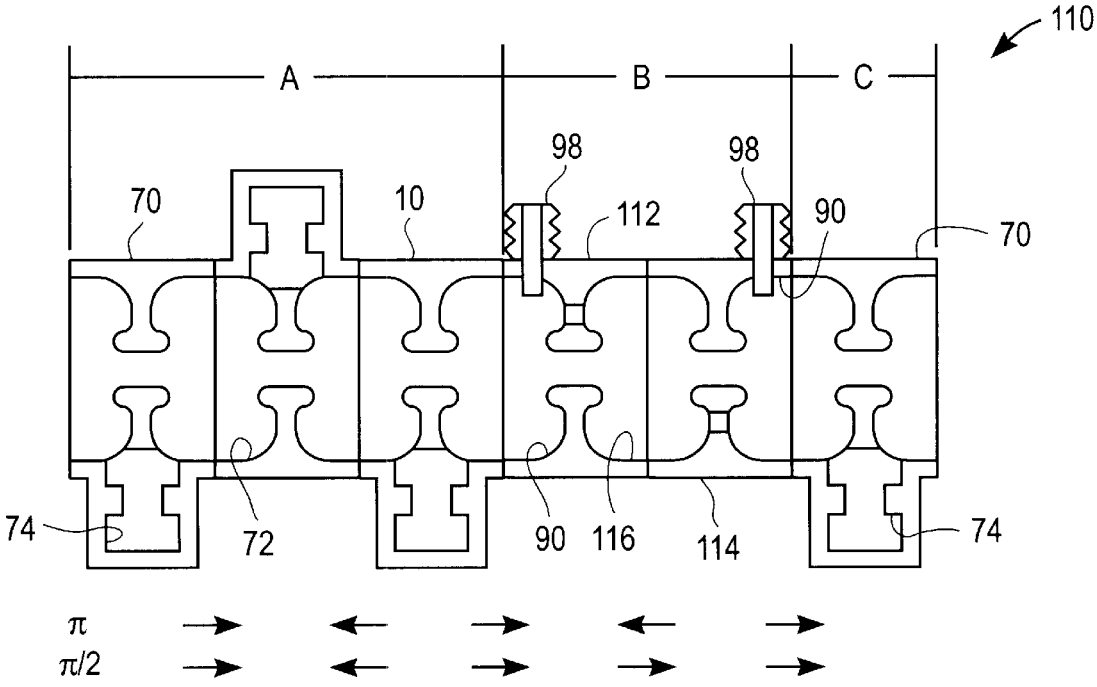
FIG. 5 is a side sectional view of a series of members connected to form a second embodiment of the present invention.

FIG. 5 illustrates a second embodiment of the linear accelerator section of the present invention, generally indicated at 110. The transition section B includes two members 112, 114 which define one full accelerating cavity and two half cavities 90. The transition section B is configured to operate in π or π/2 mode while the end sections A and C are configured to operate in π/2 mode. The accelerating mode occurs when the transition section B operates in π mode. The beam decelerates for low energy operation when the transition section operates in π/2 mode. The tuning range required for the cavity tuners 98 is reduced for this embodiment 110 as compared to the first embodiment 86. Ideally all three cavities would be tune. But for simplicity, only the end cavities 90 need to be tuned while the center cavity 116 remains at a fixed frequency. The center cavity 116 is tuned for the π mode where it is exposed to large fields and can be mistuned for the π/2 mode where it sees no field. The main effect of this mistuning is to shift the side mode frequencies closer, thus reducing the stop band. Alternatively, the π/2 mode may also be used for the accelerating mode, where the power flow is highest. This reduces power flow phase shifting for the accelerating mode. In order for the π/2 mode to accelerate, the length of the transition section B must be shortened. The cavities are either made shorter or the full cavity 116 is moved off-axis. The transition section B may be switched between the 0 mode and the π/2 mode, rather than between the π/2 mode and the π mode.

Figure 6:
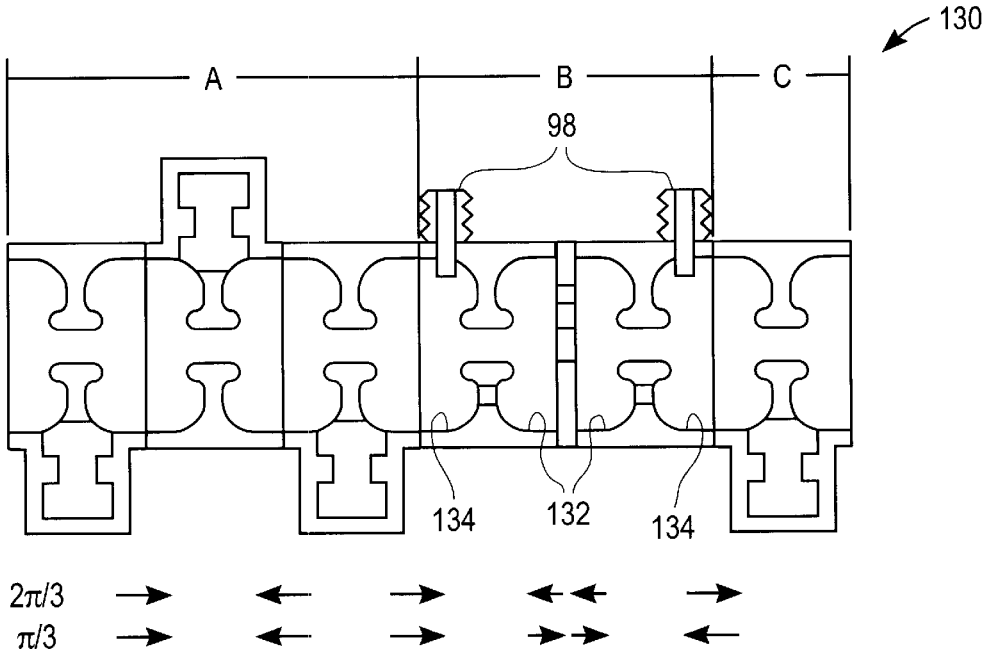
FIG. 6 is a side sectional view of a series of members connected to form a third embodiment of the present invention.

A third embodiment of the present invention is shown in FIG. 6 and generally indicated at 130. The transition section B includes two full cavities 132 and two half-cavities 134. The transition section B is configured to operate in π/3 mode or 2π/3 mode. As the field strengths in the central two cavities 132 are nominally only half of that in the end cavities 134, the central two cavities may be made half the normal length, as shown in FIG. 6. This brings the field strengths up to normal without danger of arcing. Ideally, all four cavities would be tuned, but for simplicity, the center two cavities 132 preferably remain tuned midway between the ideal tunings for the π/3 and 2π/3 modes. The transition section B may then be switched between modes by tuning only the end half-cavities 134. The fixed tuning of the center two cavities will cause some mode-mixing, but this only causes a slight change to the amplitudes of the center two cavities 132 and a slight shifting of the stop band. It will cause no phase shifts or field tilts across the transition section B. However, there will in generally still be some power flow phase shift. The required range of cavity tuners 98 is less than required for the previous embodiments 86, 110. This embodiment 130 also has the advantage that there is almost no wasted space in the accelerating mode and a high gradient is maintained.

Figure 7:
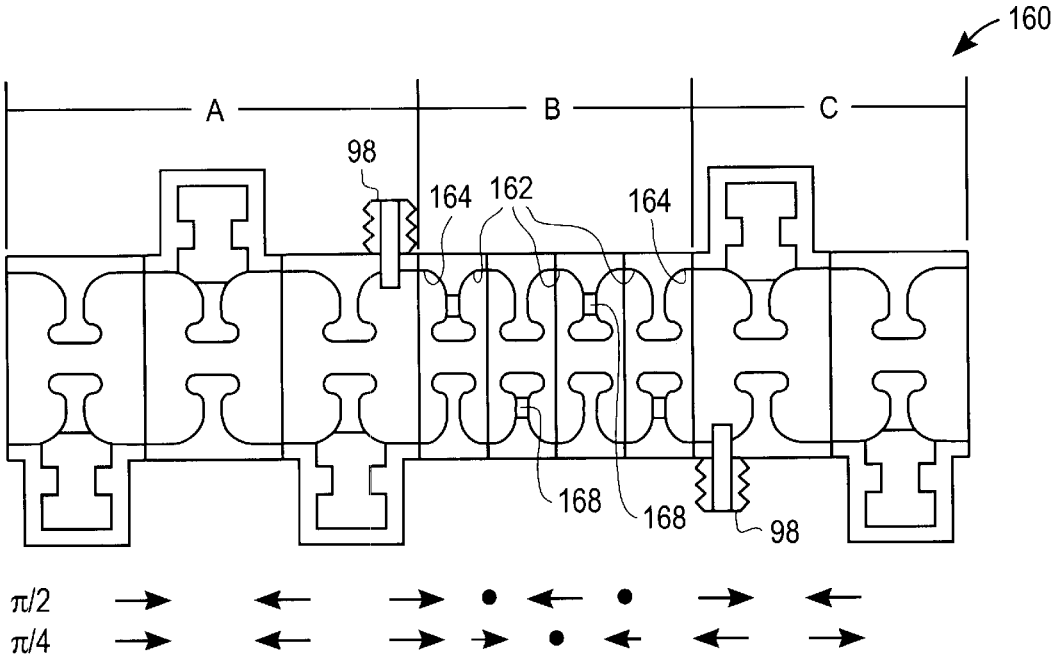
FIG. 7 is a side sectional view of a series of members connected to form a fourth embodiment of the present invention.

FIG. 7 shows a fourth embodiment of the present invention, generally indicated at 160. The transition section B comprises five resonators (three full cavities 162 and a half-cavity 164 on each end). The transition section B may be operated in either π/2 or π/4 mode. In the π/2 mode, the transition section B has a phase advance of 2π and in the π/4 mode the transition section has an advance of π. Thus, the phase between the normal π/2 accelerator structures A, C on each end may be varied by π and the downstream section C may be switched to either accelerate or decelerate the beam. The cavities 162 may be shortened slightly to allow the π/2 mode of the transition section B to be the accelerating mode for the beam. This configuration will waste some of the length by placing unexcited cavities along the beam. This can be remedied by moving two or more of the main cavities 162 to the side, as shown in FIG. 8.

Figure 8:
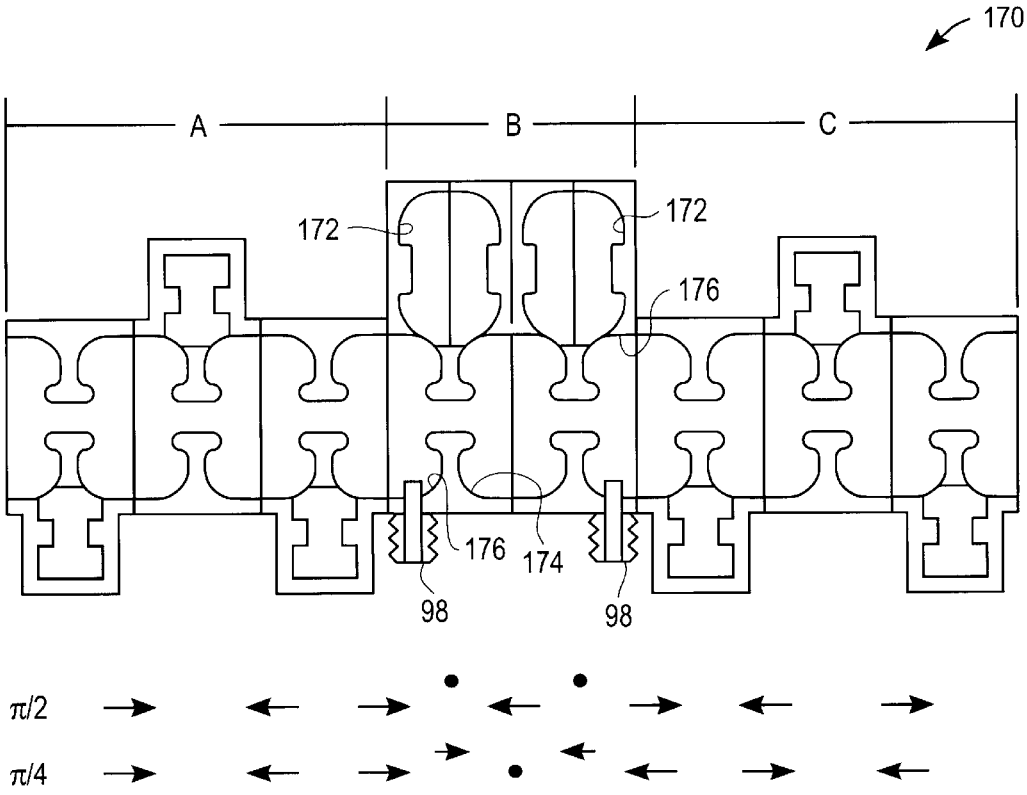
FIG. 8 is a side sectional view of a series of members connected to form a fifth embodiment of the present invention.

FIG. 8 illustrates a fifth embodiment of the present invention, generally indicated at 170. As described above, this embodiment 170 is similar to the embodiment 160 shown in FIG. 7 except that two of the main cavities 162 have been moved to the side (FIG. 8). The transition section B thus comprises three full cavities 172, and two half cavities 176.

It is to be understood that the accelerator may be viewed as having a different number of sections than described herein without departing from the scope of the invention. For example, the embodiment of FIG. 4 may be viewed as having two sections that meet at the center of section B. The embodiment of FIG. 8 may be viewed as having a single section with two tunable cavities and two off-axis cavities.

The following example illustrates the principles and advantages of the invention. PARMELA simulations were run of a commercial Siemens accelerator which had been designed for optimum performance at around 18 MeV. In these simulations, a 180 degree phase flip was inserted at a variable location along the accelerator, simulating the effect of inserting a short transition section as described above, at this location. The results showed that relatively efficient operation (more than 30% capture of injected electrons) can be attained at energies as low as 4 MeV. This is more than six times the capture attained in the same accelerator by simply reducing RF power to reduce the cavity excitations.

The coupling matrices have also been analytically solved for the cases of 2, 3, and 4 cavities in the transition section B. The results showed that if only the end cavities of a 3 or 4 cavity section are tuned and the central cavities remain at a fixed frequency, the transition section B may still be tuned to cause either of the two collective resonant mode frequencies to match the $\pi/2$ frequency of the end sections A, C of the accelerator. The modes become mixed and the stopbands shift, but this does not introduce any phase shifts or field tilts between the two ends of the transition section.

A two cavity transition section (as shown in FIG. 4) was also machined and cold-tested with a $\pi/2$ section A. Measurements confirmed that the modes of the structure remained well separated as the transition section was tuned.

Although the present invention has been described in accordance with the embodiments shown, one of ordinary skill in the art will readily recognize that there could be many variations to the embodiment and these variations would be within the spirit and scope of the present invention. Accordingly, many modifications may be made by one of ordinary skill in the art without departing from the spirit and scope of the appended claims.

What is claimed is:

1. A device for use in a linear accelerator operable to accelerate charged particles along a beam axis, the device comprising a first end section, a second end section, and a transition section interposed between the first and second end sections, the sections being connected together to form a plurality of accelerating cavities aligned along said beam axis and coupling cavities, wherein the first and second sections are configured to operate in fixed collective resonant modes and the transition section is tunable such that different resonant modes of the transition section may be tuned to lie at generally the same frequency as the resonant modes of the first and second sections.

2. The device of claim 1 wherein the transition section is tunable to resonate in two different collective modes.

3. The device of claim 1 wherein the device is configured for use in medical applications.

4. The device of claim 1 wherein the transition section comprises two half-cavities, each of the half cavities being connected with a half cavity from one of the end sections to form an accelerating cavity.

5. The device of claim 4 wherein the transition section is tunable to operate in two different collective modes.

6. The device of claim 5 wherein one of the collective modes allows each of the half-cavities of the transition section to resonate generally in phase and the other of the modes allows the half-cavities to resonate generally 180 degrees out of phase.

7. The device of claim 5 wherein one of the modes is a $\pi$ operating mode and the other mode is a 0 operating mode.

8. The device of claim 4 wherein the accelerating cavities located at ends of the transition section include two tuning devices.

9. The device of claim 4 wherein the half-cavities of the transition section are coupled through an opening in a cavity wall common to the half-cavities.

10. The device of claim 1 wherein the transition section comprises one full cavity and two half-cavities.

11. The device of claim 10 wherein the accelerating cavities at the ends of the transition section include two tuning devices.

12. The device of claim 11 wherein each tuning device is disposed within one of the half-cavities.

13. The device of claim 10 wherein the transition section is configured to operate in a $\pi$ mode and a $\pi/2$ mode.

14. The device of claim 10 wherein the transition section is configured to operate in a 0 mode and a $\pi/2$ mode.

15. The device of claim 1 wherein the transition section comprises three full cavities and two half-cavities.

16. The device of claim 15 wherein the transition section is configured to operate in $\pi/2$ mode and $\pi/4$ mode.

17. The device of claim 15 wherein the transition section is configured to operate in $\pi/2$ mode and $3\pi/4$ mode.

18. The device of claim 1 wherein the transition section comprises one accelerating cavity and two half-cavities, each half cavity being coupled to the accelerating cavity of the transition section through a side coupling cavity.

19. The device of claim 1 wherein the fixed collective resonant mode of the first and second end sections is a $\pi/2$ mode.

20. A system for delivering charged particles, the system comprising:

a particle accelerator having an input for connection to a source of charged particles and a beam path extending to an exit window, the particle accelerator comprising a first end section, a second end section, and a transition section interposed between the first and second end sections, the sections being connected together to form a plurality of accelerating cavities aligned along said beam path, wherein the first and second sections are configured to operate in fixed collective resonant modes and the transition section is tunable such that resonant modes of the transition section may be tuned to lie at generally the same frequency as the resonant modes of the first and second sections; and a signal source for energy transfer engagement with the charged particles within the particle accelerator.

21. The system of claim 20 wherein the transition section is tunable to resonate in two different collective modes.

22. The system of claim 20 wherein the device is configured for use in medical applications.

23. The system of claim 20 wherein the transition section comprises two half-cavities, each of the half cavities being coupled with a half cavity from one of the end sections to form an accelerating cavity.

24. The system of claim 23 wherein the transition section is tunable to operate in two different collective modes.

25. The system of claim 24 wherein one of the collective modes allows each of the half-cavities of the transition section to resonate generally in phase and the other of the modes allows the half-cavities to resonate generally 180 degrees out of phase.

26. The system of claim 24 wherein one of the modes is a $\pi$ operating mode and the other mode is a 0 operating mode.

27. The system of claim 23 wherein the transition section comprises two tuning devices.

28. The system of claim 27 wherein the transition section comprises two deformable cavities.

29. The system of claim 23 wherein the half-cavities of the transition section are coupled through an opening in a common cavity wall separating the half-cavities.

30. The system of claim 20 wherein the transition section comprises one accelerating cavity and two half-cavities.

31. The system of claim 30 wherein the transition section comprises two tuning devices.

32. The system of claim 31 wherein each of the tuning devices is disposed within one of the half-cavities.

33. The system of claim 31 wherein the transition section is configured to operate in a $\pi$ mode and a $\pi/2$ mode.

34. The system of claim 31 wherein the transition section is configured to operate in a 0 mode and a $\pi/2$ mode.

35. The system of claim 20 wherein the transition section comprises three accelerating cavities and two half-cavities.

36. The system of claim 35 wherein the transition section is configured to operate in $\pi/2$ mode and $\pi/4$ mode.

37. The system of claim 35 wherein the transition section is configured to operate in $\pi/2$ mode and $3\pi/4$ mode.

38. The system of claim 20 wherein the transition section comprises one accelerating cavity and two half-cavities, each half cavity being coupled to the accelerating cavity of the transition section through a side coupling cavity.

39. The device of claim 20 wherein the fixed collective resonant mode of the first and second end sections is a $\pi/2$ mode.

40. A device for use in a linear accelerator operable to accelerate charged particles along a beam axis, the device comprising first and second sections, the sections being connected together to form a plurality of accelerating cavities aligned along said beam axis and coupling cavities, wherein the first section is configured to operate in fixed collective resonant modes and the second section is tunable such that different resonant modes of the transition section may be tuned to lie at generally the same frequency as the resonant mode of the first section.

* * * * *